US006457188B1

(12) United States Patent
Lindberg

(10) Patent No.: US 6,457,188 B1
(45) Date of Patent: Oct. 1, 2002

(54) WATER AND SEWAGE EVACUATION ASSEMBLY

(76) Inventor: Thomas Henry Lindberg, 3987 Lamot St., San Diego, CA (US) 92109

( * ) Notice: Subject to any disclaimer, the term of this patent is extended or adjusted under 35 U.S.C. 154(b) by 0 days.

(21) Appl. No.: 09/847,028

(22) Filed: May 1, 2001

Related U.S. Application Data

(60) Provisional application No. 60/274,541, filed on Mar. 9, 2001.

(51) Int. Cl.[7] ..... E03D 11/00

(52) U.S. Cl. ..... 4/420; 4/251.1; 4/251.2; 4/591

(58) Field of Search ..... 4/420, 427, 251.1, 4/251.2, 546, 559, 591, 300.3, DIG. 5, DIG. 15, DIG. 496, 510

(56) References Cited

U.S. PATENT DOCUMENTS 1,781,325 A * 11/1930 Dowling
3,262,132 A * 7/1966 Mann
3,826,192 A * 7/1974 Kattner et al.
4,165,545 A * 8/1979 Stoltzfus
4,203,173 A 5/1980 Morris et al.
4,204,285 A * 5/1980 Pak
4,258,444 A 3/1981 Orszullok
4,620,332 A * 11/1986 Laird
4,912,784 A * 4/1990 Jabcobson et al.
4,963,116 A * 10/1990 Huber
5,315,090 A * 5/1994 Lowenthal
5,730,179 A * 3/1998 Taylor
5,731,758 A 3/1998 Suttlemyre et al.
5,732,417 A 3/1998 Pondelick et al.
5,864,892 A * 2/1999 Cool
6,085,361 A * 7/2000 Whitaker

* cited by examiner

*Primary Examiner*—David J. Walczak
*Assistant Examiner*—Khoa D. Huynh
(74) *Attorney, Agent, or Firm*—St. Onge Steward Johnston & Reens LLC

(57) ABSTRACT

An evacuation assembly for a receptacle, which is traversed by a flowable substance drained through a discharge outlet, includes a housing removably attached to the receptacle and having a channel receiving the substance in case of the blocked outlet of the receptacle, and a reservoir in flow communication with the channel for storing the delivered substance.

13 Claims, 3 Drawing Sheets

WATER AND SEWAGE EVACUATION ASSEMBLY

PRIOR APPLICATION

I claim priority benefits under 35 U.S.C. §119(e) of U.S. Provisional Patent Application Ser. No. 60/274,541 filed Mar. 9, 2001.

FIELD OF THE INVENTION

The invention relates to an assembly for evacuating the overflow from a canalization system. Particularly, the invention relates to a portable gutter assembly associated with water and sewage canalization systems.

BACKGROUND OF THE INVENTION

As homeowners and those who work in and around certain types of institutions, such as retirement homes, convalescent homes, and the like, are aware, toilet bowls may become blocked for any number of reasons, and a person who repeatedly flushes such a toilet will cause it to flood. This flooding may cause serious problems, particularly for homeowners since professional help is not immediately available and for institutions, such as homes for the aged, since older people may slip and fall, or be subjected to diseases by such flooding waters.

Many patents have disclosed mechanical and electrically controlled water overflow devices to prevent the overflowing of toilets. Examples of such patents include U.S. Pat. No. 4,203,173 to Morris et al., U.S. Pat. No. 4,258,444 to Orszullok, U.S. Pat. No. 5,731,758 to Suttlemyre et al., U.S. Pat. No. 5,732,417 to Pondelick et al. These patents show that a system that detects the rise of water in a toilet bowl to a preset high-level, and then signals a valve unit to cause it to close and prevent further water delivery to the toilet system is old and well known in the art. However, the systems disclosed in these patents tend to be complicated and expensive, and fail to disclose or teach a low-cost and simple device that is mounted on or near a rim of a toilet bowl to provide a mechanically-simple structure capable of effectively preventing flooding of the area surrounding a toilet bowl. Furthermore, these patents fail to teach a system that can be detachably installed on existing toilet systems.

It is, therefore, desirable to provide a gutter system that can be removably mounted on a liquid- and/or debris-conveying system. Also desirable is a cost-efficient gutter system having a simple mechanical structure.

SUMMARY OF THE INVENTION

To attain this, the inventive device for a receptacle, which is traversed by a flowable substance drained through a discharge outlet, includes a housing detachably attached to the receptacle and having a channel receiving the substance in case of the blocked discharge outlet.

According to one aspect of the invention, an inventive gutter, mounted along a rim of the receptacle traversed by the substance, has a housing detachably mounted to the receptacle and provided with a U-shaped channel. The channel is adapted to receive overflow of the substance and to deliver it to at least one reservoir, which is in flow communication with the channel to store the evacuated substance.

In accordance with another inventive aspect, the gutter has a support removably and sealably attached to the receptacle. The support and housing are detachably engaged to one another so it is possible to periodically remove the housing and to clean debris from the housing.

In accordance with another embodiment of the invention, an evacuation or gutter assembly used in conjunction with a toilet bowl has a housing mounted to the bowl and extending around the bowl's rim. The housing has a channel receiving the overflow of the substance from the bowl's opening to guide it along an evacuation path toward a reservoir.

It is, therefore, an object of the invention to provide an evacuation assembly that can be detachably mounted to a receptacle traversed by a flowable substance to guide away the overflow of the substance in case of a blocked discharge opening of the receptacle.

Another object of the invention is to provide a cost-efficient evacuation assembly that has a simple structure which can be easily installed on and dismounted from a receptacle traversed by a substance.

Still another object of the invention is to provide an evacuation assembly that can be used with different types of toilets.

The above and other object, features and advantages will become more readily apparent from the specific description accompanied by the following drawings, in which:

DETAILED DESCRIPTION OF THE DRAWINGS

Figure 1:
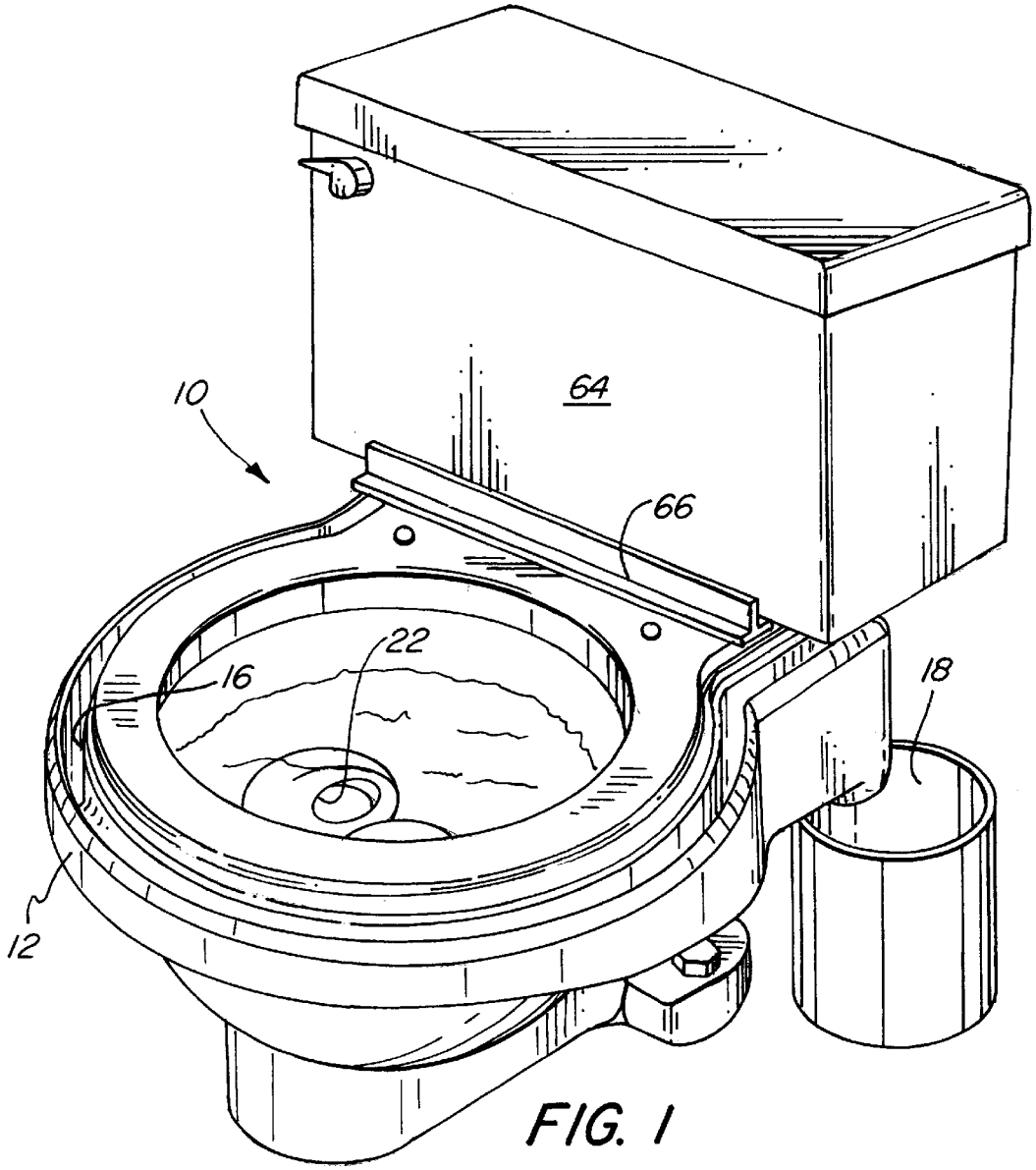
FIG. 1 is a perspective view of an evacuation assembly in accordance with the invention and shown in use with a toilet assembly.
Figure 5:
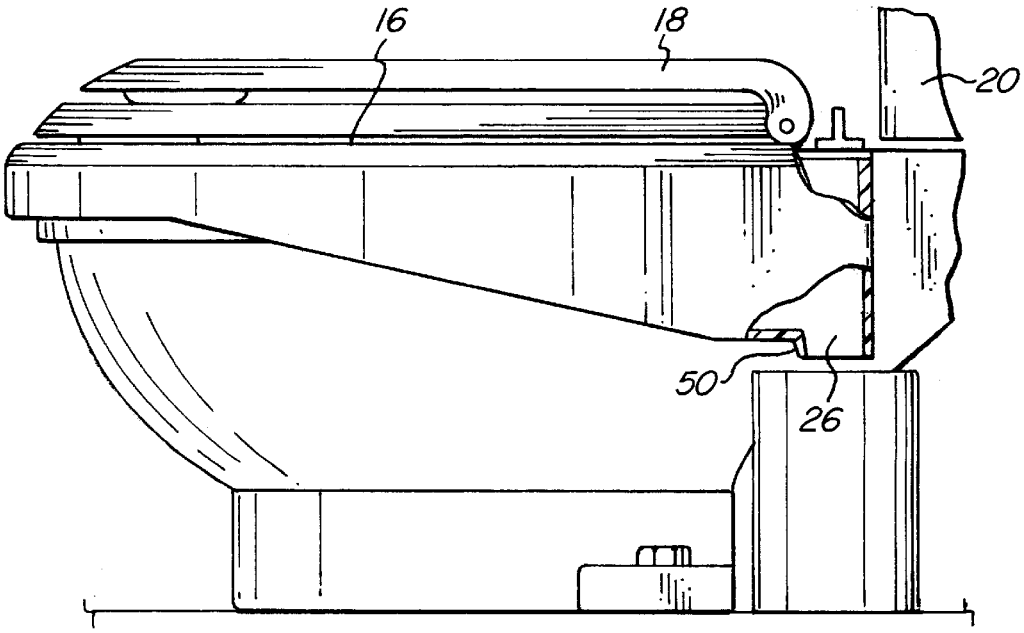
FIG. 5 is a side elevation view of the assembly shown in FIG. 1.
Figure 6:
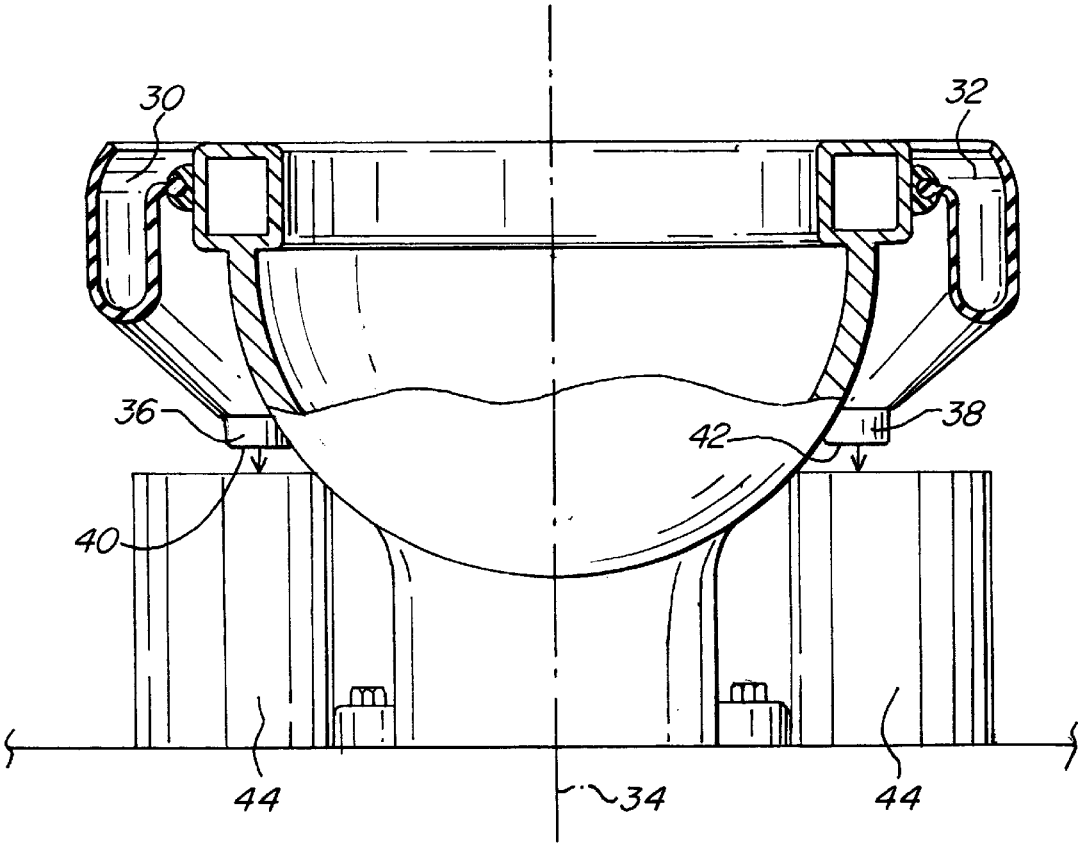
FIG. 6 is a sectional front view of another embodiment of the evacuation assembly in accordance with the invention.

Referring to FIGS. 1 and 6, a flush toilet assembly 10 is provided with an inventive evacuation assembly including a housing 12 which extends along a rim 16 (FIG. 5) and terminates between a swingable lid 18 and a water tank. The housing is constructed to receive overflow of water and/or debris coming out over the rim if a discharge opening 22 is blocked or if a rate of substance entering the toilet bowl exceeds its designed discharge rate.

Figure 2:
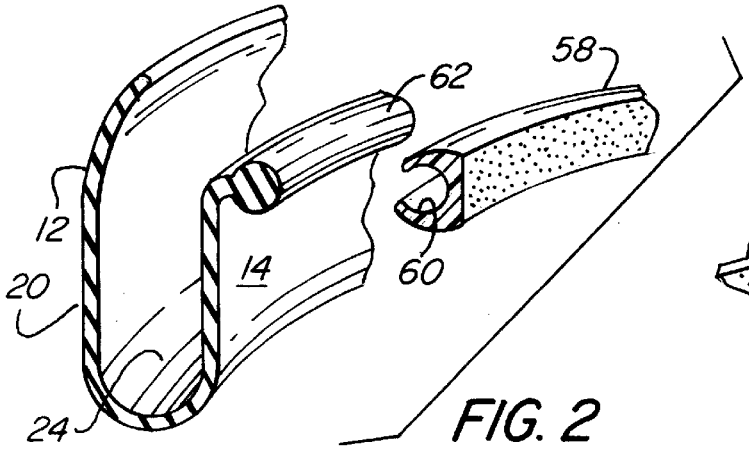
FIG. 2 is an elevation perspective view of a part of the evacuation assembly shown in FIG. 1.
Figure 3:
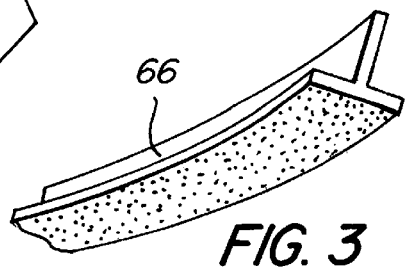
FIG. 3 is a perspective view of a detail of the evacuation assembly of FIG. 1.

To accomplish it, the housing has a U-shaped bottom and a pair of outer and inner walls 20, 14 (FIG. 2) which form a channel 24, as better seen in FIGS. 2 and 3. The inner wall 14 can be mounted flush with or somewhat below the rim 16 to allow an unrestricted waterflow to enter the channel 24, which guides the flow toward a displaceable reservoir 18. The outer wall 20 is mounted to the bowl at least at the same level as the rim, but may terminate in a plane above the rim. Flow communication between the reservoir 18 and channel 24 is provided by means of a drain opening 26 (FIG. 5) aligned with the reservoir.

The channel 24, as shown in FIG. 1, has a slope descending unidirectionally toward the drainage opening 26. FIG. 6 illustrates a modification of the evacuation assembly, wherein the channel 24 has two stretches 30 and 32 descending from a centerline 34 in opposite directions toward channel ends 36 and 38. Each of the channel ends has a respective opening 40, 42 aligned with the reservoir 44.

Accordingly, in case of overflow, two streams of substance 46, 48 (FIG. 3) are formed and received by two reservoirs, increasing thereby a storage capacity of the evacuation system. In addition, a single reservoir extending between the drainage openings 40, 42 can be used instead of two separate reservoirs.

As shown in FIGS. 1, 3 and 6, the opposite ends of the channel are closed, so the drainage openings 26, 40 and 42 are provided in a flange 50 (FIG. 4) extending downwardly towards the reservoir. Alternatively, it is possible to have at least a lower part of the channel's back ends open to provide the flow as indicated by arrow A in FIG. 3.

The housing is formed from a resilient material, such as plastic or rubber, and manufactured by any available molding method that leads to a cost-efficient structure. It is easy to envision that the hosing can have any desirable color to be aesthetically appealing. Since the toilet bowls are standardized, the peripheral dimension of the inner side will varies within a small range allowing a user to tightly press the housing against the bowl to provide a waterproof structure at the junction between the hosing and the toilet bowl.

Figure 4:
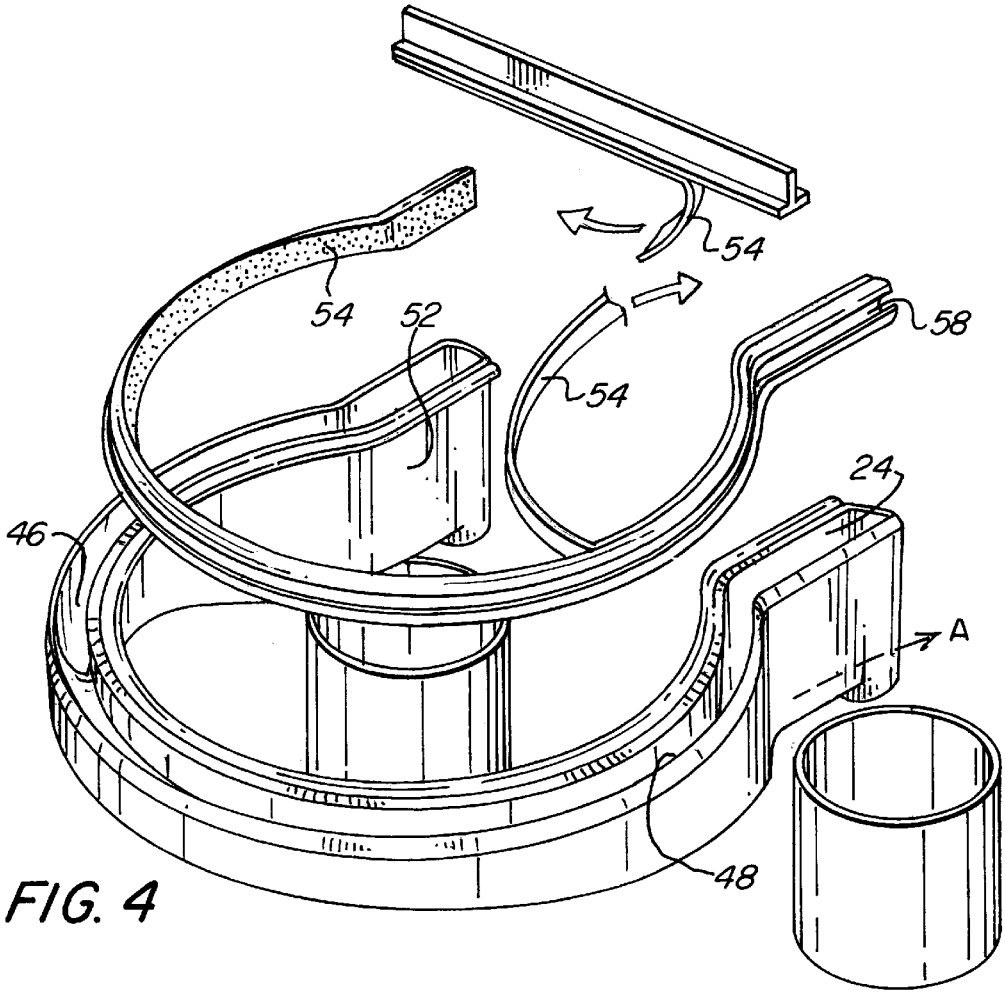
FIG. 4 is an explosive perspective view of the evacuation assembly shown in FIG. 1

To avoid unpleasant nuisance as a result of accumulated debris and stale water, the housing can be removably mounted on the bowl. An adhesive material applied between a face 52 of the inner side 20 and the toilet bowl can serve as an attachment element. Such adhesives can be a plurality of heat or pressure activated adhesive tapes, applied on top of one another. As a result, it will be easy to peel off a used tape 54 off from the inner side of the housing analogously to the manner which is shown in FIG. 4. By removing the used tape, the user exposes a new tape which can be easily attached to a desirable supporting structure of the toile bowl. Obviously, other attachment elements, such as Velcro tapes can be used as well.

Alternatively, a support 58 tightly pressed against the periphery of the bowl can be used as an element for easy removal of the housing. The support and housing can be attached to one another in a variety of ways. As an example, a zip-lock assembly can be utilized, wherein a groove or recess 60 continuously extending along the entire length of the support is so dimensioned that a flange 62 on the housing can be pressed into the recess. An external force applied to the housing can release it from the engagement. Similarly to the attachment element, as disclosed in connection with the housing, the support can have the tape 54 allowing the support to be dismounted and the bowl to be washed. Alternatively, the groove 60 can be provided on the inner side of the housing, whereas the annular rim 62 is molded with the support.

A flush toilet assembly shown in figures typically has a water tank 64. To prevent overflow over a rear segment 64 of the rim, a crossbar 66 is provide between the rim and water tank. The bar can have any desirable form and dimensions and be removably attached to the bowl.

Many known modifications of flush toilet do not require the use of the water tank. In this case, it is possible to have the housing and/or the support extend around the entire periphery of the bowl without the need to use the cross bar.

The disclosed evacuation assembly can be used in combination with any receptacle traversed by flowable substance. Accordingly, although the invention has been described with reference to a particular arrangements of parts, features and the like, these are not intended to exhaust all possible arrangements or features, and indeed many other modifications and variations will be ascertainable to those of skill in the art.

What is claimed is:

1. An assembly for evacuating overflow, comprising:

a housing adapted to be detachably mounted to a receptacle;

said housing having an inside wall, an outside wall spaced apart from said inside wall, and a bottom wall connecting said inside wall to said outside wall; said inside wall having a top surface extending along a rim of the receptacle; said inside and outside walls each having a wall height being gradually inclined as said inside wall extends along the rim, thereby defining a sloping channel adapted to receive overflow from the receptacle and to guide the overflow along the sloping channel;

at least one reservoir in flow communication with said housing to store the overflow; and a support having an inner side adapted to be mounted to the receptacle and an outer side removably attached to the housing;

wherein the outer side has a continuous recess, the housing having a flange shaped complimentary to and dimensioned to be at least equal to a diameter of the recess, so that the housing is engaged in the recess upon applying an external force.

wherein the outer side has a continuous recess, the housing having a flange shaped complimentary to and dimensioned to be at least equal to a diameter of the recess, so that the housing is engaged in the recess upon applying an external force.

2. The assembly defined in claim 1 wherein the housing has opposite ends and a U-shaped cross section defining the channel which extends between the opposite ends.

3. The assembly defined in claim 1 wherein the channel is inclined with respect to a horizontal to provide a single stream of the substance along the.

4. The assembly defined in claim 1 wherein the channel has two stretches inclined in opposite directions to provide two oppositely flowing streams of the substance, each of which flows toward a respective one of the ends of the housing.

5. The assembly defined in claim 4 wherein each of the one and other reservoirs is juxtaposed with a respective one of the opposite ends of the housing, each of the ends of the housing having a respective evacuation opening which has an axis extending transversely to a plane of the channel.

6. The assembly defined in claim 4 wherein the opposite ends of the housing are open for providing the flow of the substance.

7. The assembly defined in claim 2, further comprising a cross-bar bridging the opposite ends of the housing, each of said housing and bar having a respective side sealingly attached to the receptacle to prevent flow of the substance between the attached sides and the receptacle.

8. The assembly defined in claim 7 further comprising at least one layer of sealing material between the side and the receptacle to provide detachment of the housing from the receptacle upon applying an external force.

9. The assembly defined in claim 7 wherein the sealing material is selected from the group consisting of heat and pressure activated adhesive materials.

10. The assembly defined in claim 1 wherein the housing is made from a polymeric material.

11. The assembly defined in claim 1 wherein the housing extends continuously around the rim of the receptacle to have an endless channel.

12. An assembly for evacuating overflow, comprising:

a receptacle;

a housing detachably mounted to said receptacle for receiving overflow, said housing having an inner surface facing said receptacle, an outside wall spaced apart from said inner surface, and a bottom wall connecting said inner surface to said outside wall;

said inner surface, said outside wall and said bottom wall forming a channel for evacuating overflow;

said housing further comprising a flange; and a securing mechanism for removably securing said inner surface to said receptacle, wherein said securing mechanism is a support having a recess and being mounted to said receptacle, and wherein said flange is placed in said recess for removably securing said inner surface to said receptacle.

13. assembly according to claim 12, wherein said securing mechanism is an adhesive.

* * * * *